US007039340B1

(12) United States Patent
Goebel

(10) Patent No.: US 7,039,340 B1
(45) Date of Patent: May 2, 2006

(54) UNIVERSAL DRUM COVER FOR XEROGRAPHIC DEVICE CARTRIDGES

(75) Inventor: Thomas A. Goebel, Austin, TX (US)

(73) Assignee: Tonerhead, Inc., McHenry, IL (US)

( * ) Notice: Subject to any disclaimer, the term of this patent is extended or adjusted under 35 U.S.C. 154(b) by 78 days.

(21) Appl. No.: 10/736,158

(22) Filed: Dec. 15, 2003

Related U.S. Application Data

(60) Provisional application No. 60/433,476, filed on Dec. 13, 2002.

(51) Int. Cl.
*G03G 15/00* (2006.01)
*G03G 21/18* (2006.01)

(52) U.S. Cl. ..... 399/114

(58) Field of Classification Search ..... 399/114, 399/111, 110, 107, 109, 116, 117
See application file for complete search history.

(56) References Cited

U.S. PATENT DOCUMENTS 4,470,689 A * 9/1984 Nomura et al. ..... 399/114
4,655,578 A * 4/1987 Kurtz et al. ..... 399/114
5,231,453 A * 7/1993 Nakai et al. ..... 399/114
5,266,999 A * 11/1993 Yashiro ..... 399/114
5,307,117 A * 4/1994 Harlan ..... 399/114
6,091,916 A * 7/2000 Dycher ..... 399/114
2004/0126134 A1* 7/2004 Harada et al. ..... 399/114
2004/0190936 A1* 9/2004 Yoshiyuki et al. ..... 399/114

FOREIGN PATENT DOCUMENTS

JP 60-063550 A * 4/1985
JP 04-066961 A * 3/1992
JP 05-080600 A * 4/1993
JP 06-035247 A * 2/1994
JP 10-133513 A * 5/1998
JP 2001-282079 A * 10/2001

* cited by examiner

*Primary Examiner*—Sophia S. Chen
(74) *Attorney, Agent, or Firm*—Vedder Price Kaufman & Kammholz

(57) ABSTRACT

A drum cover or protector includes features that allow it to be used with substantially any xerographic device cartridge designed to be used in a xerographic device adapted to handle standard paper sizes. The drum protector may be secured to the cartridge in a protecting position. In this position, the protector covers the drum and blocks objects from coming into contact with the drum surface. The drum protector also includes an arrangement that prevents any critical part of the drum surface from coming into contact with the cover itself.

8 Claims, 4 Drawing Sheets

UNIVERSAL DRUM COVER FOR XEROGRAPHIC DEVICE CARTRIDGES

CROSS-REFERENCE TO RELATED APPLICATION

This application is related to U.S. Provisional Patent Application Ser. No. 60/433,476 filed Dec. 13, 2002, and entitled, UNIVERSAL DRUM COVER FOR XEROGRAPHIC DEVICE CARTRIDGES. The Applicant claims the benefit of this prior provisional application under 35 U.S.C. §119(e). The entire content of this provisional application is incorporated herein by this reference.

TECHNICAL FIELD OF THE INVENTION

This invention relates to xerographic device cartridges, and, more particularly, to a protective cover for protecting the drum in a xerographic device cartridge while the cartridge is not installed in a xerographic device.

BACKGROUND OF THE INVENTION

Xerography is a printing process in which very fine powder referred to as "toner" is applied to paper or other material to form an image. Photocopiers, printers, plotters, and facsimile machines are examples of devices that may utilize a xerographic printing or imaging process. As used in this disclosure "xerographic device" encompasses any type of device using a xerographic imaging process. All xerographic devices require a supply of toner for use in the xerographic process. Because the toner supply in a xerographic device is used up in the printing process, the toner supply must be replenished periodically.

Toner is commonly supplied in a cartridge that includes a toner bin or hopper. The cartridge also commonly includes other components of the xerographic device. For example, toner cartridges commonly include an organic photo conductive (OPC) roller assembly used in the xerographic process. This OPC roller assembly includes a roller referred to as a "drum" and a bearing structure for receiving an axle associated with the drum and supporting the drum for rotation in the cartridge. In the xerographic printing process the drum is exposed to the paper on which the image is to be transferred. Thus, in many types of cartridges the drum is mounted adjacent to a slot or opening in the cartridge with a portion of the drum extending out through the slot in an exposed position.

Because the surface of the drum is susceptible to scratches and other damage that diminishes imaging quality, the drum must be covered or otherwise protected during times when the cartridge is not installed in a xerographic device. Some prior xerographic device cartridges have included a shutter mechanism for protecting the xerographic drum in the cartridge while the cartridge is not installed in a printer. The shutter mechanism is configured to automatically retract to expose the drum as the cartridge is installed into a xerographic device. These shutter mechanisms had the advantage that they did not require the consumer to modify the printer cartridge or remove anything prior to installing the cartridge. Shutter mechanisms were, however, expensive to manufacture and were themselves subject to damage that could prevent them from operating properly. Thus, many current xerographic device cartridges eliminate the shutter mechanism and instead use a removable cover to protect the drum. This removable cover must be physically removed by the user before installing the cartridge into the xerographic device.

Some xerographic device cartridges that eliminate the shutter mechanism are shipped from the original equipment manufacturer with a hard plastic cover that connects over the bearing structure associated with the drum included in the cartridge. As with any fixed cover, this plastic cover must be removed by the user prior to inserting the cartridge into the xerographic device.

Cartridges which are originally supplied with xerographic devices are commonly intended to be disposable after a single use. However, because the cartridges include a large number of relatively complex and expensive components, using these cartridges only a single time is expensive and wasteful. For this reason a cartridge recycling industry has developed to refurbish and recycle used cartridges. Refurbishing a used cartridge involves at least refilling the depleted toner bin with toner, and may include other tasks. Where the cartridge includes an exposed drum, the cartridge recycler must again protect the exposed drum prior to shipping the refurbished cartridge.

The requirement of protecting the exposed drum in many newer xerographic cartridges has posed problems for the cartridge recycling industry. The hard plastic covers that attach over the bearing structures for the drum are specific to the particular cartridge. That is, a cover suitable for one cartridge cannot be used with another type of cartridge. This is a problem for a toner cartridge recycler because it requires the recycler to maintain a separate stock of covers (assuming the covers are even available) for each type of printer cartridge the recycler handles. In order to reduce costs, some recyclers have been using flat paper or cardboard covers that are simply taped on over the exposed drum. However, the flat paper or cardboard covers touch the drum surface and this contact may damage the drum. Thus, there is a need particularly in the xerographic device cartridge recycling industry for a better way to cover and protect the exposed drum in a cartridge while the cartridge is in storage or in transit.

SUMMARY OF THE INVENTION

The present invention comprises a drum cover or protector that is universal in that it may be used with substantially any xerographic device cartridge designed to be used in a xerographic device adapted to handle standard paper sizes. The universal drum protector may be secured to the cartridge in a protecting position. In this position, the protector covers the drum and blocks objects from coming into contact with the drum surface. The universal drum protector also includes an arrangement that prevents any critical part of the drum surface from coming into contact with the cover itself.

A drum protector according to the invention includes an elongated protector member that is slightly wider than the drum slot through which the drum is exposed in a xerographic device. The elongated protector member is also just long enough to extend the length of a xerographic drum used in a device adapted to handle standard paper sizes. The elongated protector member includes a central arched section that extends longitudinally down the center of the protector member. The central arched section is located between two lateral flanges that each extends generally the length of the protector member. An end spacer is located at each longitudinal end of the protector member defining an end of the central arched section. When the protector member is placed in the protecting position, contact between the end spacers and the very ends of the drum or parts adjacent to the ends of the drum and/or contact between the flanges and the material adjacent to the drum slot ensures that the inside surface of the central arched section is spaced slightly apart from the critical parts of the drum surface. Yet in this protecting position the protector member covers the drum to shield the drum from objects that could otherwise come into contact with and damage the drum surface.

These and other advantages and features of the invention will be apparent from the following description of the preferred embodiments, considered along with the accompanying drawings.

DESCRIPTION OF PREFERRED EMBODIMENTS

Figure 1:
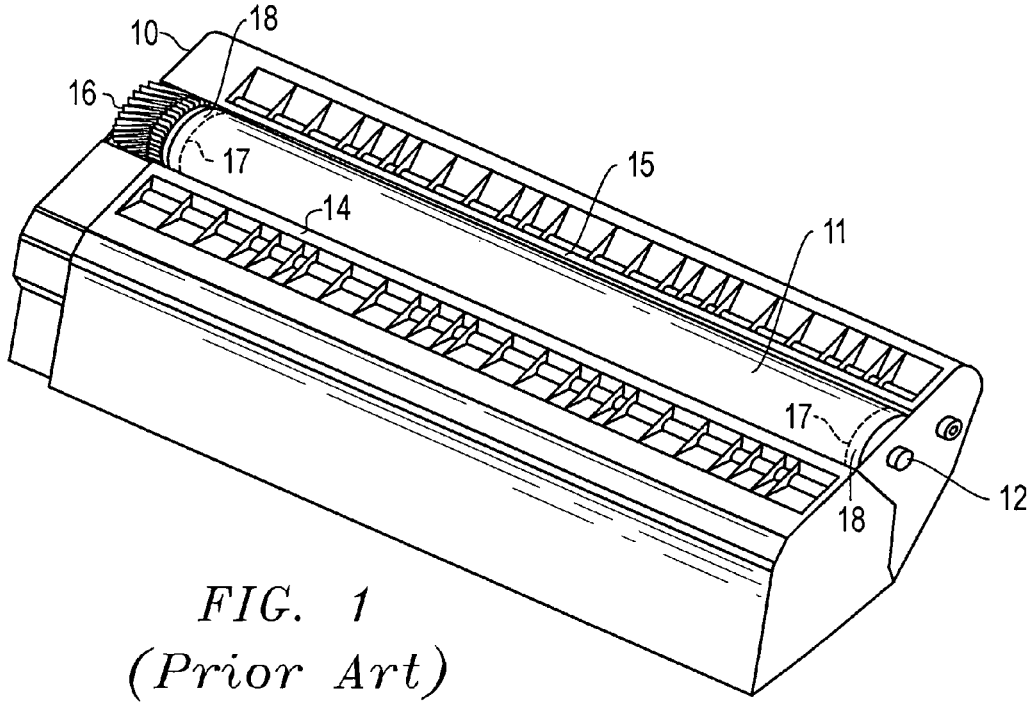
FIG. 1 (Prior Art)
FIG. 1 is a view in perspective of a prior art xerographic device cartridge with which a protector according to the invention may be used.

FIG. 1 shows a prior art xerographic device cartridge 10 having an exposed drum 11. Drum 11 is exposed through a slot or opening formed in cartridge 10. This slot is defined generally between a first lateral edge 14 and a second lateral edge 15. It will be noted from FIG. 1 that a portion of drum 11 extends above the plane defined by lateral slot edges 14 and 15. This portion of drum 11 is positioned so that it may easily come into contact with other objects as the cartridge is handled. Drum 11 is supported for rotation on bearing surfaces associated with bearing structures 12, each bearing structure extending slightly from the respective end of cartridge 10. Drive gears shown at reference numeral 16 provide means for transferring rotational force to drum 11. The illustrated drum 11 includes a central section defined between dashed lines 17. This central section extends almost the entire length of drum 11 and includes a special surface critical to the xerographic imaging process. However, short end sections 18 may not include the special surface required for xerographic imaging and are not implicated in the xerographic imaging process. Even where the special surface on the drum extends to the very end of the drum, there is generally a short length of the drum at each end that is not used in the xerographic imaging process. The portion of the drum used in the xerographic imaging process, that is the portion between the drum end portion that are not used in the xerographic imaging process will be referred to herein as the drum critical imaging area.

It will be noted from FIG. 1 that the material adjacent to slot edges 14 and 15 may include irregular features such as ridges, indentations, or projections. In fact, there is great variation among different cartridges in the nature of the surfaces adjacent to the slot edges. There is also a good deal of variation between different cartridges in the components such as gears, bearing structures, and other features at the ends of the drum. However, due to the standard sizes of paper for which the xerographic devices are designed, the length and diameter of the drum in various xerographic device cartridges are fairly consistent. The length of the drum from one end to the other minus any gears or drive structures is generally slightly over ten (10) inches for xerographic devices adapted to handle paper having a nominal width of up to about eight and one-half (8.5). For xerographic devices adapted to handle paper having a nominal width of up to about eleven (11) inches, the drum length minus drive gears and support structures is generally about thirteen (13) inches. The width of the slot defined between the slot through which the drum protrudes will generally be approximately one and three-eighths (1.375) inch.

Figure 2:
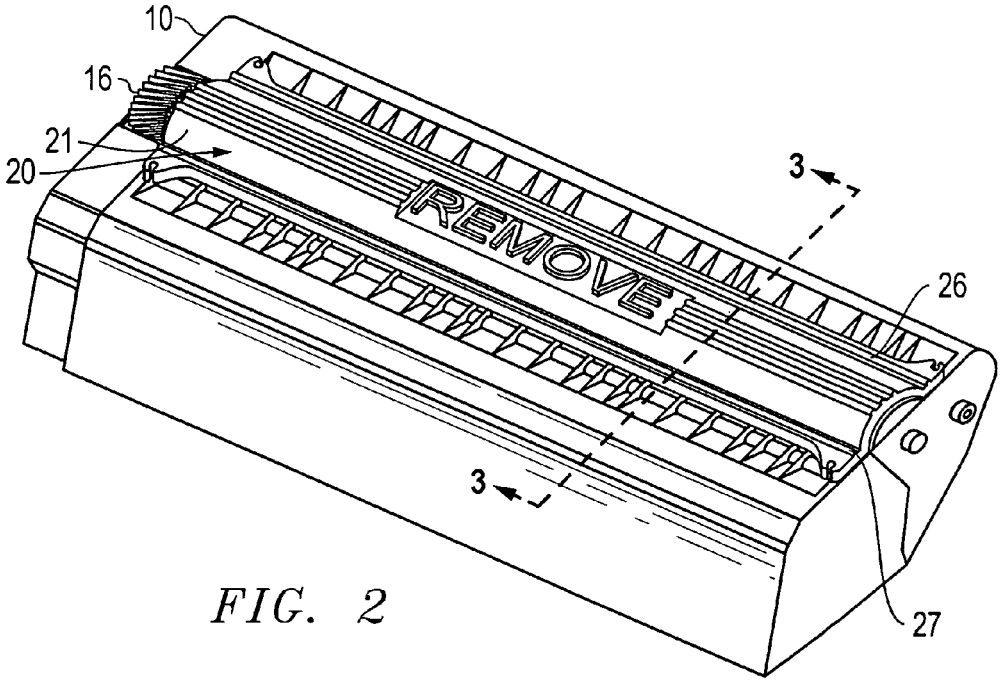
FIG. 2 is a view in perspective similar to FIG. 1, but with a drum protector embodying the principles on the invention positioned over the drum in a protecting position.
Figure 3:
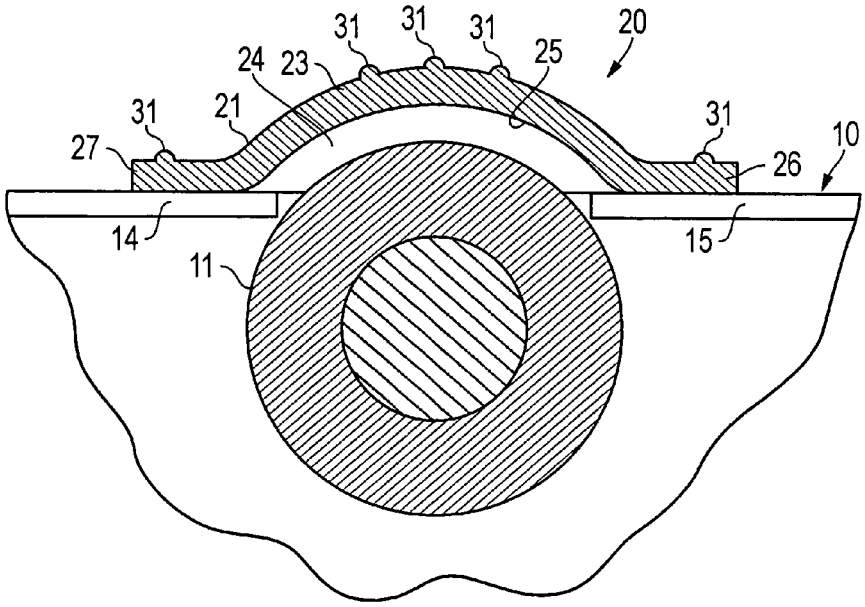
FIG. 3 is a partial view in section taken along line 3—3 in FIG. 2.

FIGS. 2 and 3 show a protector generally at reference numeral 20 embodying the principles of the invention positioned on cartridge 10 over drum 11 in a protecting position according to the present invention. The various elements included in the preferred illustrated protector 20 will first be described with reference to FIGS. 4 through 6. This description of protector 20 will be followed by a description of the operation of the protector with reference to FIGS. 2 and 3.

Figure 4:
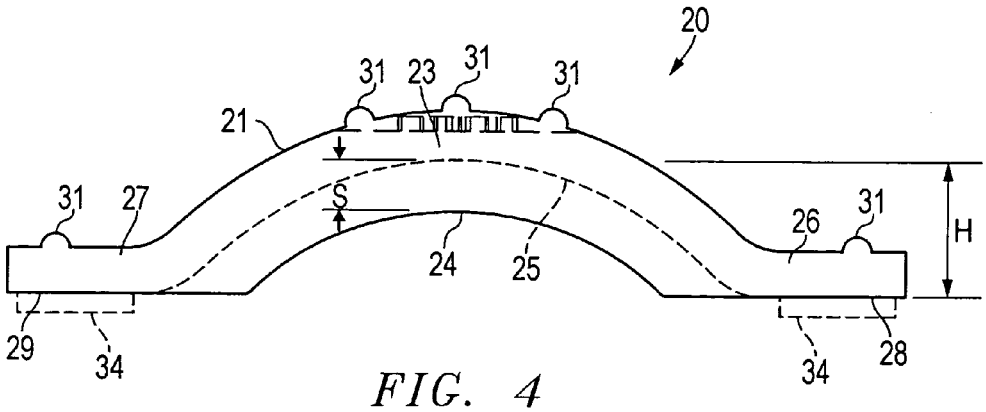
FIG. 4 is an end view of the protector shown in FIG. 2.
Figure 5:
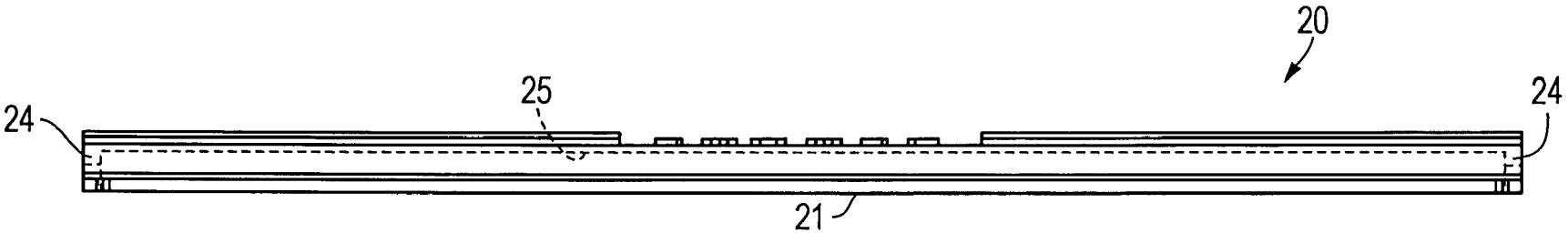
FIG. 5 is a side view of the protector shown in FIG. 2.
Figure 6:
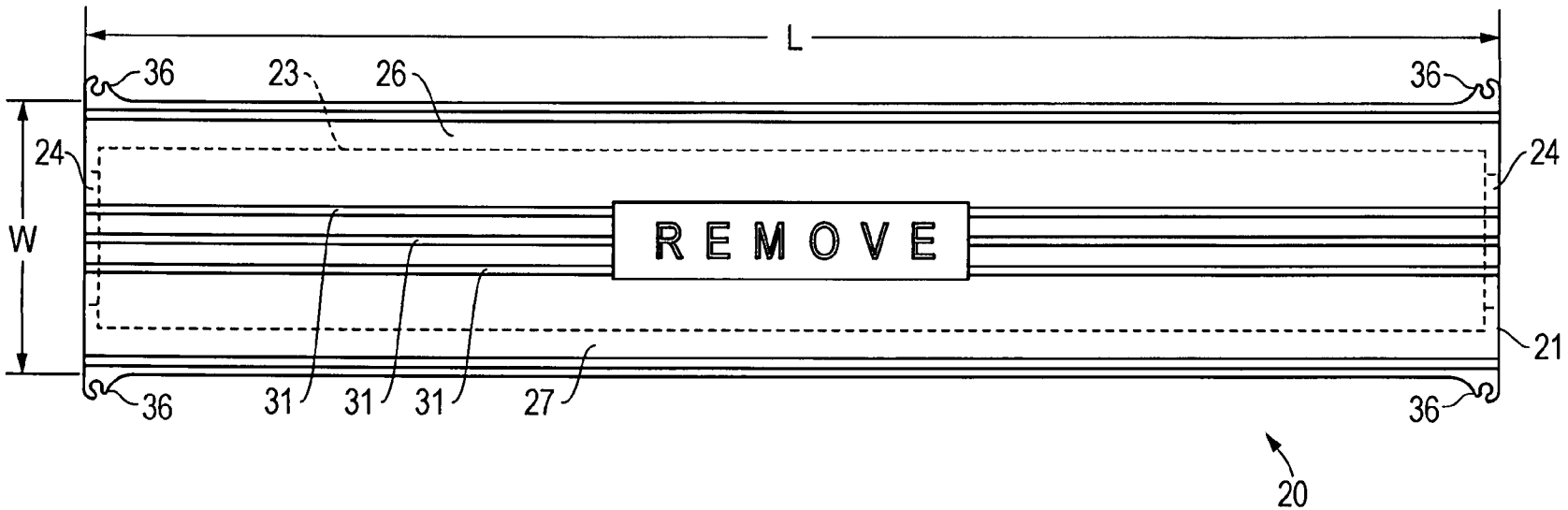
FIG. 6 is a top view of the protector shown in FIG. 2.

As shown in FIGS. 4 through 6, protector 20 comprises an elongated piece of suitable material that will be referred to herein as protector member 21 and having generally a rectangular shape when viewed from above as shown in FIG. 6. Protector member 21 includes a central arched section 23 that extends longitudinally almost the entire length of the elongated protector member. Each longitudinal end of protector member 21 includes an end spacer 24. The illustrated end spacers 24 each comprise a short ridge or lip of material extending from an inner surface 25 of arched section 23. Lateral side flanges 26 and 27 extend along the entire length of protector member 21 on both sides of arched section 23. Side flange 26 includes bottom surface 28, while side flange 27 includes a bottom surface 29.

The illustrated protector member 21 includes longitudinal ridges formed on the upper surface of the protector. These longitudinal ridges 31 help provide longitudinal rigidity to protector member 21. The projecting longitudinal ridges 31 allow protector member 21 to be gripped more easily from the top side. Also, the illustrated protector member 21 includes a text instruction on the top side. The instruction prompts the user to remove protector 20 from a cartridge on which it is mounted prior to inserting the cartridge into a xerographic device. Other features that may be included with a protector 20 embodying the principles on the invention include strips 34 positioned on the bottom flange surfaces 28 and 29. Each strip 34 may include a layer of adhesive, a layer of resilient foam material, referred to herein as a contour forming material, or a layer of resilient contour forming material with adhesive retaining the material on the respective surface 28 or 29, and possibly another adhesive on the side of the material facing away from the respective surface 28 or 29. In any case, each strip 34 may extend along the entire longitudinal length of the respective flange or may be discontinuous along the flange. It will be appreciated that where strip 34 includes an outwardly facing adhesive, a layer of peel-off cover material will be required to protect the adhesive until the protector 20 is to be secured in the desired protecting position on a cartridge such as cartridge 10 in FIGS. 1 and 2.

Protector member 21 is preferably molded from a suitable plastic to form a substantially rigid protective structure. Alternatively, protector 20 may be formed from a rigid cardboard or any other suitable material for accomplishing the protective function according to the present invention. The overall length L of protector 20 will be slightly over 10 inches and preferably approximately 10.18 inches for use with cartridges designed for xerographic devices that handle standard paper sizes up to 8.5 inches in width. The overall width W of protector 20 will be slightly over 1.375 inches (the common width of the slot through which a drum protrudes) and preferably approximately 1.88 inches. The dimension S shown in FIG. 4 between the distal end of end spacer 24 and inner surface 25 is preferably approximately one-sixteenth to one-eighth inch. This dimension S will depend upon the rigidity of the material from which protector member 21 is formed. The more rigid the material, the smaller the dimension that will ensure that inner surface 25 does not contact the drum critical imaging area over which the protector 20 is secured.

Referring now to FIGS. 2 and 3, protector 20 is adapted to be positioned in a protecting position over drum 11. As best shown in FIG. 2, when protector 20 is in this protecting position, substantially the entire surface of drum 11, and especially the drum critical imaging area (shown between lines 17 in FIG. 1) is completely covered by protector member 21. As shown in FIG. 3, arched section inner surface 25 is spaced apart from the drum surface (by at least dimension S in FIG. 4) sufficiently to ensure that the critical surface of drum 11 does not come into contact with the inner surface 25. Distance S is preferably selected to accommodate some flexure in protector member 21 and still prevent any contact between the critical surface of drum 11 and surface 25. The desired spacing between arched section inner surface 25 and the outer surface of drum 11 is ensured primarily by the end spacer elements 24 at each longitudinal end of protector member 21. These end spacers 24 are located in position to come into contact with at most the very extreme end surface of drum 11 when protector 20 is in the protecting position, well outside of the drum critical imaging area. When the lowermost surface of end spacers 24 come in contact with the very end surface of drum 11, the end spacers function as stops to maintain the desired spacing between the drum critical imaging area and the arched section inner surface 25. Flanges 26 and 27 also help ensure the desired spacing from the surface of drum 11 in the critical area. That is, even if the end spacers 24 do not come in contact with the very end sections (18 in FIG. 1) of drum 11 such as when the drum is slightly shorter than normal or when the protector member 21 is not centered over the drum, the distance between the flange lower surfaces 28 and 29 and arched section inner surface 25 (H in FIG. 4) ensures that inner surface 25 may not come into contact with the critical surface of drum 11. Flanges 26 and 27 also prevent protector 20 from sliding about the periphery of drum 11. Such sliding would otherwise be possible due to the fact that end spacers 24 contact the curved surface of drum 11.

Protector 20 may be secured in the protecting position shown in FIGS. 2 and 3 in any suitable fashion. In one preferred form of the invention one or more bonding or securing elements may be used to secure protector 20 in the protecting position. One preferred securing element may comprise a strip of adhesive tape secured transversely over protector member 21 so that ends of the tape extend past flanges 26 and 27 so as to adhere to the surface of cartridge 10. Another preferred securing element comprises an adhesive material strip of foam 34, located on the bottom surfaces 28 and 29 of flanges 26 and 27. A cover strip may be peeled off to expose the adhesive and then the protector member 21 may be pressed onto cartridge 10 in the protecting position. The adhesive holds the protector member 21 in the desired position. The foam or other contour-conforming material that may be included in strip 34, whether an outer adhesive is associated with the material or otherwise, has the advantage of conforming to any irregular surface that may be located on slot edges 14 and 15 shown in FIGS. 1 and 2.

Rubber bands or similar resilient elements (not shown) may also be used to secure protector 20 in the protecting position shown in FIGS. 2 and 3. To facilitate the use of such resilient elements to secure protector 20, preferred forms of the device include resilient element receiving features at either longitudinal end of member 21 to help retain the resilient elements in position on the protector. For example, the illustrated protector 20 includes resilient element receiving features 36 shown best in FIG. 6. These features 36 provide a convenient location to loop both ends of a rubber band or similar resilient element. With the appropriately sized resilient element retained on features 36 at both lateral sides of protector 20, the resilient element may be stretched over a feature on the cartridge such as bearing structure 12 shown in FIG. 1. Resilient elements fastened in this way at both ends of protector 20 hold the protector snugly in the protecting position on the cartridge.

The above described preferred embodiments are intended to illustrate the principles of the invention, but not to limit the scope of the invention. Various other embodiments and modifications to these preferred embodiments may be made by those skilled in the art without departing from the scope of the invention. In particular, although the preferred protector 20 includes both spacing features, end spacers 24 and flanges 26 and 27, some preferred forms of the protector according to the invention may have one or the other feature but not both. The invention encompasses a protector with either one of the spacing features alone or both spacing features together as shown in the illustrated embodiment.

The invention claimed is:

1. A drum protector for a printer cartridge, the cartridge having an elongated drum with a drum critical imaging area extending along a substantial portion of the length of the drum, the drum also having relatively short end sections at both ends thereof, the protector including:

(a) an elongated protector member having a length greater than the drum critical imaging area, the elongated protector member adapted to be positioned in a protecting position over the drum, having at least one side flange portion on at least one long side of the elongated protector member;

(b) a central raised section extending longitudinally on the elongated protector member, the raised section having a length sufficient to cover the drum critical imaging area and a height sufficient to provide a clearance above the drum critical imaging area when the protector is in the protecting position; and (c) at least two end spacers extending from the inner surface of the raised section at a location such that they are outside of the drum critical imaging area when the protector is in the protecting position.

2. The protector of claim 1 further including at least one strip of contour-conforming material bonded to a bottom surface of the at least one side flange portion.

3. The protector of claim 1 wherein the strip of contour-conforming material includes an adhesive bonding surface on the bottom for removably bonding to the printer cartridge.

4. A drum protector for a printer cartridge, the cartridge having an elongated drum with a drum critical imaging area extending along a substantial portion of the length of the drum, the drum also having relatively short end sections at both ends thereof, the protector including:

(a) an elongated protector member having a length greater than the drum critical imaging area, the elongated protector member adapted to be positioned in a protecting position over the drum, having at least one side flange portion on at least one long side of the elongated protector member;

(b) a central raised section extending longitudinally on the elongated protector member, the raised section having a length sufficient to cover the drum critical imaging area and a height sufficient to provide a clearance above the drum critical imaging area when the protector is in the protecting position;

(c) at least two end spacers extending from the inner surface of the raised section at a location such that they are outside of the drum critical imaging area when the protector is in the protecting position (d) and further including a first resilient element receiving feature located at a first longitudinal end of the elongated protector member and a second resilient element receiving feature located at a second longitudinal end of the elongated protector member.

5. A drum protector for a printer cartridge, the cartridge having an elongated drum with a drum critical imaging area extending along a substantial portion of the length of the drum, the drum also having relatively short end sections at both ends thereof, the protector including:

(a) an elongated protector member having a length greater than the drum critical imaging area, the elongated protector member adapted to be positioned in a protecting position over the drum, having at least one side flange portion on at least one long side of the elongated protector member;

(b) a central raised section extending longitudinally on the elongated protector member, the raised section having a length sufficient to cover the drum critical imaging area and a height sufficient to provide a clearance above the drum critical imaging area when the protector is in the protecting position;

(c) at least two end spacers extending from the inner surface of the raised section at a location such that they are outside of the drum critical imaging area when the protector is in the protecting position;

(d) and further including at least one ridge extending along a substantial portion of the elongated protector member in the longitudinal direction.

6. A method of protecting a printer cartridge drum, the drum having a drum critical imaging area extending along a substantial portion of the length thereof and further having relatively short end sections at both ends thereof, the method including the steps:

(a) positioning a protector over the drum in a manner such that the protector rests on the short end sections; and (b) securing the protector over the drum with one or more securing elements and wherein the step of securing the protector including positioning at least one resilient element around a component of the cartridge and engaging the at least one resilient element with at least one resilient element receiving feature on the protector.

7. A drum protector of a printer cartridge, the cartridge having a drum with a drum critical imaging area extending along a substantial portion of the length of the drum, the drum also having relatively short end sections at both ends, the protector including:

(a) an elongated protector member, the elongated protector member adapted to be positioned in a protecting position over the drum;

(b) a central raised section extending longitudinally on the elongated protector member, the raised section having an inner surface, a length sufficient to cover the drum critical imaging area, and a height sufficient to provide a clearance above the drum critical imaging area when the protector is in the protecting position; and (c) at least two end spacers extending from a bottom surface of the protector member, each end spacer being adapted to rest on a respective short end section of the drum so as to maintain a clearance between the drum critical imaging area and the elongated protector member when the protector member is in the protecting position and including at least one strip of contour-conforming material secured to a bottom surface along one lateral flange of the protector member.

8. A drum protector of a printer cartridge, the cartridge having a drum with a drum critical imaging area extending along a substantial portion of the length of the drum, the drum also having relatively short end section at both ends, the protector including:

(a) an elongated protector member, the elongated protector member adapted to be positioned in a protecting position over the drum;

(b) a central raised section extending longitudinally on the elongated protector member, the raised section having an inner surface, a length sufficient to cover the drum critical imaging area, and a height sufficient to provide a clearance above the drum critical imaging area when the protector is in the protecting position; and (c) at least two end spacers extending from a bottom surface of the protector member, each end spacer being adapted to rest on a respective short end section of the drum so as to maintain a clearance between the drum critical imaging area and the elongated protector member when the protector member is in the protecting position and including a first resilient element receiving feature located at a first longitudinal end of the elongated protector member and a second resilient element receiving feature located at a second longitudinal end of the elongated protector member.

* * * * *